US006415479B1

(12) United States Patent
Steinberg

(10) Patent No.: US 6,415,479 B1
(45) Date of Patent: Jul. 9, 2002

(54) CLIP FOR SQUEEZING TUBES

(76) Inventor: Nathan Steinberg, 8052 Songbird Ter., Boca Raton, FL (US) 33496

( * ) Notice: Subject to any disclaimer, the term of this patent is extended or adjusted under 35 U.S.C. 154(b) by 0 days.

(21) Appl. No.: 09/990,289

(22) Filed: Nov. 23, 2001

Related U.S. Application Data

(60) Provisional application No. 60/295,497, filed on Jun. 4, 2001.

(51) Int. Cl.[7] ..... B65D 33/28; B65D 35/28

(52) U.S. Cl. ..... 24/30.5 R; 24/563; 24/30.5 W; 222/103

(58) Field of Search ..... 24/30.5 R, 30.5 W, 24/563, 546, 570; 222/103; 383/64, 65, 69, 71, 906, 121

(56) References Cited

U.S. PATENT DOCUMENTS 2,390,314 A * 12/1945 Massey ..... 222/103
3,865,304 A * 2/1975 Mojonnier et al. ..... 383/82
4,166,571 A * 9/1979 Niedecker ..... 383/71
4,818,120 A * 4/1989 Addiego ..... 383/5
4,964,746 A 10/1990 Huang
4,976,380 A * 12/1990 Von Schuckmann ..... 222/103
5,005,264 A * 4/1991 Breen ..... 24/30.5 R
5,152,034 A 10/1992 Koning et al.
5,373,965 A 12/1994 Halm et al.
5,608,949 A * 3/1997 Cooley et al. ..... 24/30.5 R
5,682,649 A 11/1997 Lo
6,273,608 B1 * 8/2001 Ward, Jr. et al. ..... 383/33

* cited by examiner

*Primary Examiner*—Robert J. Sandy
(74) *Attorney, Agent, or Firm*—Patent & Trademark Services; Joseph H. McGlynn

(57) ABSTRACT

A clip that can be either permanently affixed to a tube or removable from a tube having foldable wings is folded about the tube allowing the user to fully extrude the product contained within the tube. In order to retain the folded shape of the tube, the clip has foldable wings, which are folded around the tube.

8 Claims, 2 Drawing Sheets

FIG.1
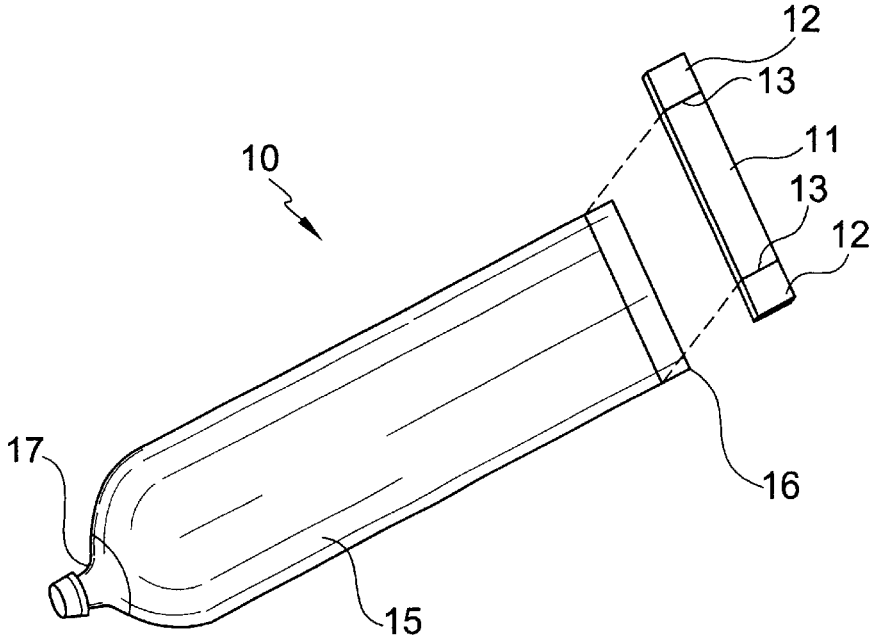
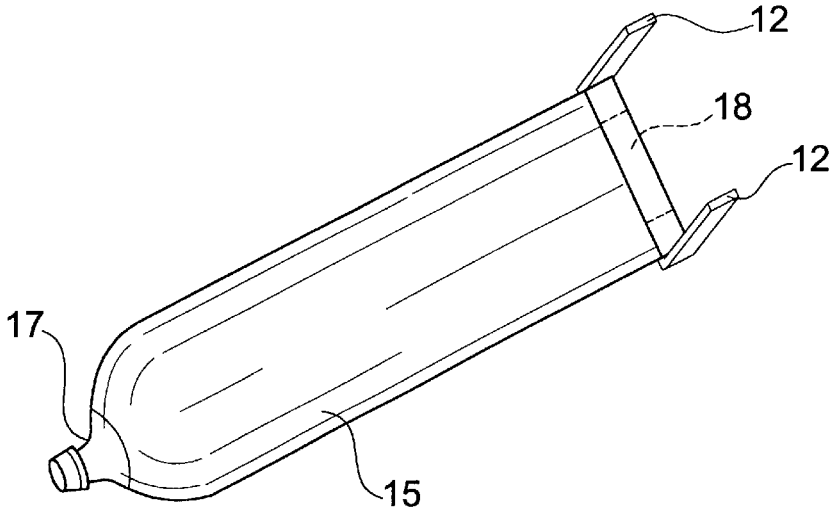
FIG.2

FIG.3
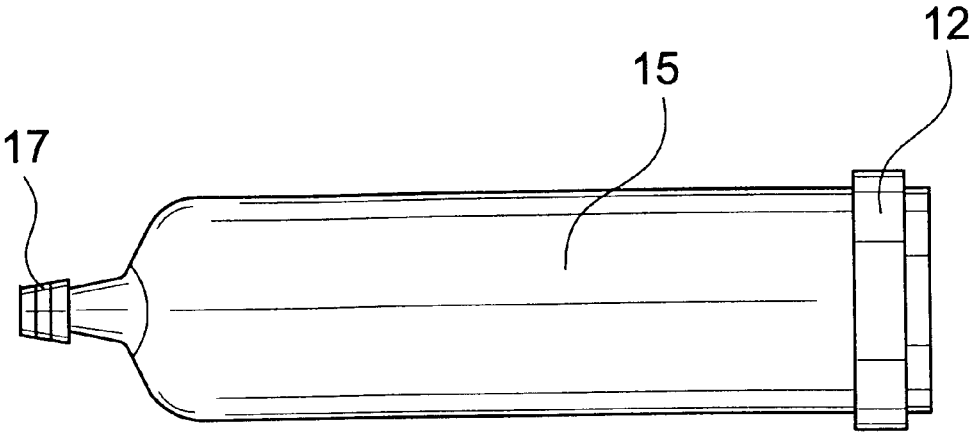
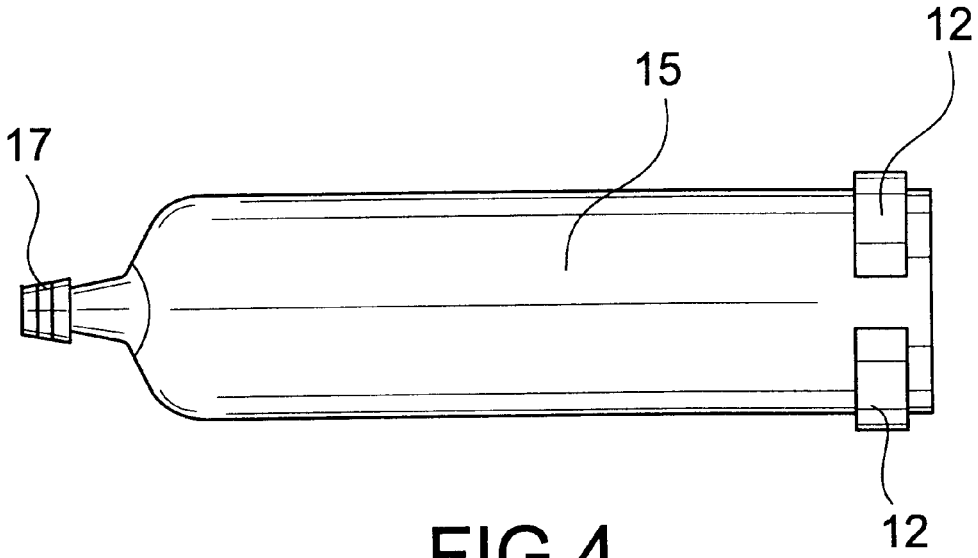
FIG.4

CLIP FOR SQUEEZING TUBES

This application claims the benefit of U.S. provisional application Ser. No. 60/295,497, filed Jun. 4, 2001.

BACKGROUND OF THE INVENTION

This invention relates, in general, to a clip, and, in particular, to a clip for squeezing tubes.

DESCRIPTION OF THE PRIOR ART

In the prior art various types of device for squeezing tubes have been proposed. For example, U.S. Pat. No. 5,682,649 to Lo discloses a sealing clip strip having wings that extend beyond the edges of the item to be sealed.

U.S. Pat. No. 5,152,034 to Konings et al. discloses a bag closure device with interlocking flanges to hold the device on a bag.

U.S. Pat. No. 4,964,746 to Huang discloses a clip with extending wings for positioning paper documents.

U.S. Pat. No. 5,373,965 to Halm et al. discloses a collapsible container with a closed end and a nozzle on the open end.

SUMMARY OF THE INVENTION

The present invention is directed to a clip, which may be placed on the sealed end of a tube to efficiently squeeze the contents out of the tube. Alternatively, the clip may be permanently attached during the manufacture of the tube. The clip features wings, which might be foldable, thereby increasing the area of pressure and leverage.

It is an object of the present invention to provide a new and improved clip for squeezing tubes.

It is an object of the present invention to provide a new and improved clip for squeezing a tube having foldable wings.

It is an object of the present invention to provide a new and improved clip for squeezing a tube that is releasably attached to a tube.

It is an object of the present invention to provide a new and improved clip for squeezing a tube that is permanently affixed to the tube.

It is an object of the present invention to provide a new and improved clip for squeezing a tube that will allow for the efficient use of the product.

These and other objects and advantages of the present invention will be fully apparent from the following description, when taken in connection with the annexed drawings.

BRIEF DESCRIPTION OF THE DRAWINGS

FIG. 1 is a perspective view of the present invention showing a clip about to be attached to a tube.

FIG. 2 is a perspective view of the present invention showing a clip attached to a tube.

FIG. 3 is a side view of the present invention showing a clip attached to a tube.

FIG. 4 is a bottom view of the present invention showing a clip attached to a tube.

DESCRIPTION OF THE PREFERRED EMBODIMENT

Conventional tubes, such as toothpaste tubes, are an inefficient means for dispersing a product. Users typically squeeze the tube causing the product to be extruded. However, this is extremely inefficient since some of the product may still be inside the tube when the user chooses to discard it.

In order to avoid this problem, the present invention is designed to have a clip that may be either releasably attached to a tube, or the clip may be permanently affixed to the tube. When the user squeezes a tube, the user can roll the end of the tube and fold the wings of the present invention about the tube, allowing the tube to stay in its rolled shape. The present invention, thereby allows the user to remove the product contained within the tube giving the user monetary savings since the present invention allows for the total use of the contents within the tube.

Referring now to the drawings in greater detail, FIG. 1 shows the present invention 10 having a clip 11 as it is about to be secured to the tube. The clip has wings 12 attached to the sides of the clip 11. The wings can be unitary with the clip 11 and can have score lines 13 to make it easier to bend the wings toward the clip 11. The tube shown is a conventional toothpaste tube having a closed end 16 and a nozzle 17. It should be noted that the present invention, as shown in FIG. 1, is merely for illustration purposes only and should not be considered the only shape, or form, the present invention could be. For example, the present invention 10 may rounded and could be virtually any shape and size, and made from any material known within the art. Additionally, the present invention 10 could be manufactured in different colors. Also, the contents of the tube 15 does not have to be toothpaste, but can be any product that comes in a squeezable tube.

As shown in FIG. 2, the clip 11 with the wings 12 are permanently attached to the bottom of the tube 11 whereas the clip in FIG. 1 is separate from the tube. In all other respects, the two embodiments are the same.

FIGS. 3 and 4 show the side and bottom of the tube, respectfully, with the clip secured to the tube.

In order to use the present invention 10, the user attaches the clip 11 to the closed end 16 of a conventional tube 15. The clip 11 is releasably attached to the end 16 of a tube 15 (as shown in FIG. 1) or can be permanently attached to the tube (as shown in FIG. 2) by an adhesive-like substance 18, or the like, which is on the clip 11. It should be appreciated that the adhesive-like substance might be semi-permanent; therefore, when the user has dispensed the entire product from tube 15, the user can remove clip 11 from the end 16 to use on another product. Instead of an adhesive-like substance on the back of the clip 11, the clip 11 might be attached to the end 16 of tube 15 via a clamp, or the like. Either method of attaching clip 11 to the end 16 of tube 15 allows the user to remove clip 11 after the user has dispensed the product from tube 15. It should be appreciated that clip 11 can be attached to any tube 15 known within the art and the tube 15 may contain a variety of products, such as tooth paste, gel, cream, liquids, medical products, lotions, or the like.

Wings 12 are made from materials well known within the art that allow wings 12, 13 to be bendable and allow the wings to retain its shape in a semi-permanent form.

After the user attaches clip 11 to the tube, the user folds tube 15 around clip 11. One of ordinary skill would appreciate that. during the folding process, the product contained in tube 15 is compressed, thus leaving little product to waste unlike the conventional method. Once the user folds tube 15 around clip 11, the user folds down wings 12 around the folded portion of tube 15, so that tube 15 will retain its modified form. Then whenever the user wants to extrude more of the product from the tube 15, he/she merely has to roll the bottom of the tube 16 up toward the nozzle 17. The clip 11 and the wings 12 will help to squeeze all of the product from the tube. Therefore, clip 11 and its method of using has a simple application and use, helps remove most of the product from tube 15 and allows a user monetary savings and benefits by allowing a user the total use of the product content in tube 15.

Although the Clip for Squeezing Tubes and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A clip for squeezing a product from a tube in combination with a tube containing a product, wherein the tube has a closed end and an open end, said clip having a length, width and a thickness, wings attached at opposite ends of said clip, means between said clip and said wings for allowing said wings to be folded with respect to said clip, said clip having adhesive means for attaching said clip to said closed end of said tube.

2. The clip as claimed in claim 1, wherein said clip and said wings are unitary.

3. The clip as claimed in claim 1, wherein said clip and said wings are made from a bendable material.

4. The clip as claimed in claim 1, wherein said means between said clip and said wings for allowing said wings to be folded with respect to said clip is a score line between said clip and said wings.

5. A clip for squeezing a product from a tube, wherein the tube has a closed end and an open end, said clip comprising:

said clip having a length, width and a thickness, wings attached at opposite ends of said clip, means between said clip and said wings for allowing said wings to be folded with respect to said clip, and wherein said clip has adhesive means for securing said clip to said tube, and wherein said adhesive means is semi-permanent adhesive, whereby said clip may be removed from one tube and secured to another.

6. The clip as claimed in claim 5, wherein said clip and said wings are unitary.

7. The clip as claimed in claim 5, wherein said clip and said wings are made from a bendable material.

8. The clip as claimed in claim 5, wherein said means between said clip and said wings for allowing said wings to be folded with respect to said clip is a score line between said clip and said wings.

* * * * *